US007311295B2

(12) United States Patent
Ha

(10) Patent No.: US 7,311,295 B2
(45) Date of Patent: Dec. 25, 2007

(54) CYLINDER APPARATUS FOR HYDRAULIC LIFT JACK WITH TRANSMISSION

(76) Inventor: Tae-Hong Ha, 457-7 jangan 3-dong, Dongdaemun-gu, Seoul (KR)

( * ) Notice: Subject to any disclaimer, the term of this patent is extended or adjusted under 35 U.S.C. 154(b) by 111 days.

(21) Appl. No.: 11/259,360

(22) Filed: Oct. 27, 2005

(65) Prior Publication Data

US 2007/0051932 A1 Mar. 8, 2007

(30) Foreign Application Priority Data

Sep. 8, 2005 (KR) ..... 10-2005-0083704

(51) Int. Cl.
*B66F 3/22* (2006.01)

(52) U.S. Cl. ..... 254/122; 254/126

(58) Field of Classification Search ..... 254/122, 254/126, 8 R

See application file for complete search history.

(56) References Cited

U.S. PATENT DOCUMENTS 4,447,041 A * 5/1984 Fujita ..... 254/9 R
5,375,681 A * 12/1994 Eickmann ..... 187/237
6,974,123 B2 * 12/2005 Latvys ..... 254/122
2007/0051932 A1 * 3/2007 Ha ..... 254/122

* cited by examiner

*Primary Examiner*—Lee D. Wilson
(74) *Attorney, Agent, or Firm*—Stites & Harbison PLLC; Douglas E. Jackson

(57) ABSTRACT

A cylinder apparatus is provided for a hydraulic lift jack with a transmission device so that the ascending velocity is high with no load and the ascending velocity is low when there is a load. The cylinder apparatus includes a lifting mechanism for moving an upper plate up and down by the hydraulic pressure in the hydraulic cylinders and a fluid pumping mechanism for in-taking the oil stored in the oil tank and pumping the oil to the outside. The cylinder apparatus also includes a piston installed to move reciprocally within the main hydraulic cylinder, and a pumping transmission mechanism including a transmission control for controlling the pumping volume of the oil so that the ascending velocity can be controlled progressively. An oil pressure removing portion removes the pressure of the piston so that the pumping mechanism then can supply a little volume of oil.

5 Claims, 22 Drawing Sheets

CYLINDER APPARATUS FOR HYDRAULIC LIFT JACK WITH TRANSMISSION

BACKGROUND OF THE INVENTION

1. Field of the Invention

The present invention relates to a cylinder apparatus for a hydraulic lift jack with a transmission device, in particular, to a cylinder apparatus for a hydraulic lift jack with a transmission device, in which the lift jack can be accurately located at the lower portion of an object to be loaded in a narrow place by constructing an upper end portion of the lift jack such that forces can be concentrated on any one point, and a transmission device is installed to adjust an ascending and descending velocity of the lift jack by pumping the fluids so that the ascending velocity of the lift jack can be increased progressively at high velocity when the load has not been applied, and the ascending velocity of the lift jack can be increased strongly at low velocity when the load has been applied, at the time of the ascending and descending operations of the lift jack.

2. Description of the Prior Art

As generally known in the art, a jack is a device used for repairing a vehicle in case of small disorders such as tire punctuations, and so on arising urgently at the time of driving. For instance, the jack is used to lift up a wheel of a vehicle and to exchange the punctuated tire, in case of tire punctuation. Accordingly, it is one of those instruments equipped always in the vehicle so that it can be used, if required.

The jack can be classified into various types based on its shape, however, the jack of the present invention relates to a jack operated by hydraulic pressure, in particular to a jack with a hydraulic cylinder for pumping the hydraulic pressure.

As described above, if the disorder arising during the driving is so big that it cannot be repaired simply in site, or it requires an aid from the special repairman, substantial repair is performed in the repairing place.

For instance, when a repair is performed to dismantle or exchange the heavy parts such as an engine or a transmission, and so on, repair is performed at the special repairing place. In this instance, the lift jack apparatus is employed to ascend and descend the heavy parts safely and conveniently.

One of such conventional lift jack apparatus shown in FIG. 1 is disclosed in Korean Patent application Laid open No. 1999-37434 (published on Jun. 25, 1999). As shown in FIG. 1, an X-shaped beam of the conventional lift jack apparatus rotates around a pivot axis to thereby ascend and descend free end of it by means of an extended length, when the piston rod of the hydraulic cylinder is extended to thereby make the length of the piston rod extend.

It is designed that an upper plate (supporting plate) is installed at upper end portion utilizing such principle so that it can lift a vehicle loaded thereon.

As shown in FIG. 2, a modified type of lift device can be constructed by an x-shaped beam and a hydraulic cylinder, and in addition, various types of lift jack device can be constructed, however, they also cannot support parts loaded on the narrow space because the areas of all the upper plates are very big and large.

For instance, a lift jack device can be used to ascend or descend a transmission or an engine when they are assembled or dismantled from the vehicle body at the time of repair and maintenance of them. However, it is difficult to locate the upper plate accurately on a lower surface of an object because the area of the upper plate is big and large, further it is complex in that surrounding parts interfering the upper plate should be dismantled and removed at the time of locating the upper plate.

Also, as shown in FIG. 2, with regard to most of the conventional hydraulic lift jack device (if necessary, wheels can be installed), it is very inconvenient because the loaded objects should be descended from the upper plate of the jack device to ground or ascended from the ground to the upper plate, on condition that the upper plate of the lift jack device is located at about a height of 90 □when the upper plate is lowered to its maximum state. Also, it is very inconvenient to ascend and descend the very heavy objects from the ground to the upper plate located at the height of 90□. Further, it is inconvenient because separate equipment such as a hoist is required at the time of transporting the object loaded on the upper plate to the other place.

Accordingly, an invention disclosed in Korean Patent application No. 2003-72709 filed by the same applicant of this application has been developed to overcome such shortcomings described above. In this invention, a lift jack device is constructed to concentrate forces on any one place of the upper plate so that a support member can be accurately located at lower surface of the loaded object in spite of the narrow space.

However, although the hydraulic lift jack device has been constructed such that a pair of X-shaped beams are ascended concurrently by pumping fluids into a sub-cylinder by means of a main hydraulic cylinder, it caused a problem of consumption of unnecessary time in a pumping operation because repeated pumping operation is required till the upper end of the jack reaches lower surface of the object to be lifted by always supplying a predetermined volume of fluids.

In addition, if it is required to repair (dismantling/assembly) the engine or the transmission, bolts are dismantled or assembled after the vehicle is lifted to a predetermined height and the bottom surface of the engine or the transmission device is supported by the lift jack. Therefore, a number of repeated operations of the pedal for pumping fluids are required so that upper end of the jack reaches at the lower surface of the object to be lifted at the time of initial operation of the lift jack. It is inconvenient because working velocity becomes slow due to relatively great number of pumping. Also, it is inconvenient in that bolt engagement work is difficult in the narrow space because a length of the object ascended through the pumping operation is long, so that an axial line of the corresponding engagement holes and the through-hole formed at the object is not aligned, when the heavy object is lifted for assembly.

As described above, in the conventional lift jack device, it is necessary to operate the hydraulic cylinder many times till the jack reaches at the lower surface of the object, as the volume and velocity of the hydraulic pumping are always linear. Also, it is difficult to adjust the ascending height of the object accurately at the time of ascending the object, after the upper end of the jack reaches the lower surface of the object to be lifted. Additionally, it is necessary to apply lots of forces to operate the pedal for pumping the fluids to activate the hydraulic cylinder. Accordingly, it is necessary to develop a hydraulic cylinder in which workers can selectively adjust the operations of the pedal, volume and velocity of the fluid pumping based on the operation conditions.

SUMMARY OF THE INVENTION

Accordingly, the present invention has been made to solve the above-mentioned problems occurring in the prior art, and it is an object of the present invention to provide a cylinder apparatus for a hydraulic lift jack with a transmission device, in which the lift jack can be accurately located at the lower portion of an object in a narrow place by constructing an upper end portion of the lift jack such that the forces can be concentrated on any one point, and a transmission device is installed to adjust ascending and descending velocity of the lift jack to a desired degree progressively by supplying the fluids so that the ascending velocity of the lift can be increased progressively at high velocity when the load has not been applied, that is, when the lift jack activated by the hydraulic pressure is operated initially, and the ascending velocity of the lift jack can be increased strongly at low velocity when the load has been applied, at the time of the ascending and descending operations of the lift jack.

To accomplish the above object of the present invention, there is provided a cylinder apparatus for a hydraulic lift jack with a transmission device, which includes a hydraulic cylinder for pumping the oil stored in a oil tank, so that the lift jack can be ascended by the hydraulic pressure supplied by pumping, the cylinder apparatus is characterized by comprising:

lifting means including x-shaped beams for moving an upper plate pivotably engaged on an upper portion of the beam up and down by the hydraulic pressure in the hydraulic cylinder;

fluid pumping means including a main hydraulic cylinder located below the lifting means for in-taking the oil stored in the oil tank installed at inside of a base frame and pumping it to the outside, and a piston installed to move reciprocatably within the main hydraulic cylinder; and pumping transmission means including a transmission control portion installed at the outside of the fluid pumping means for controlling the pumping volume of the fluid so that ascending velocity of a lift portion can be controlled progressively, an oil pressure removing portion in the piston for removing the pressure of the oil flowed into the piston by the transmission control portion so that it can supply a little volume of fluids.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
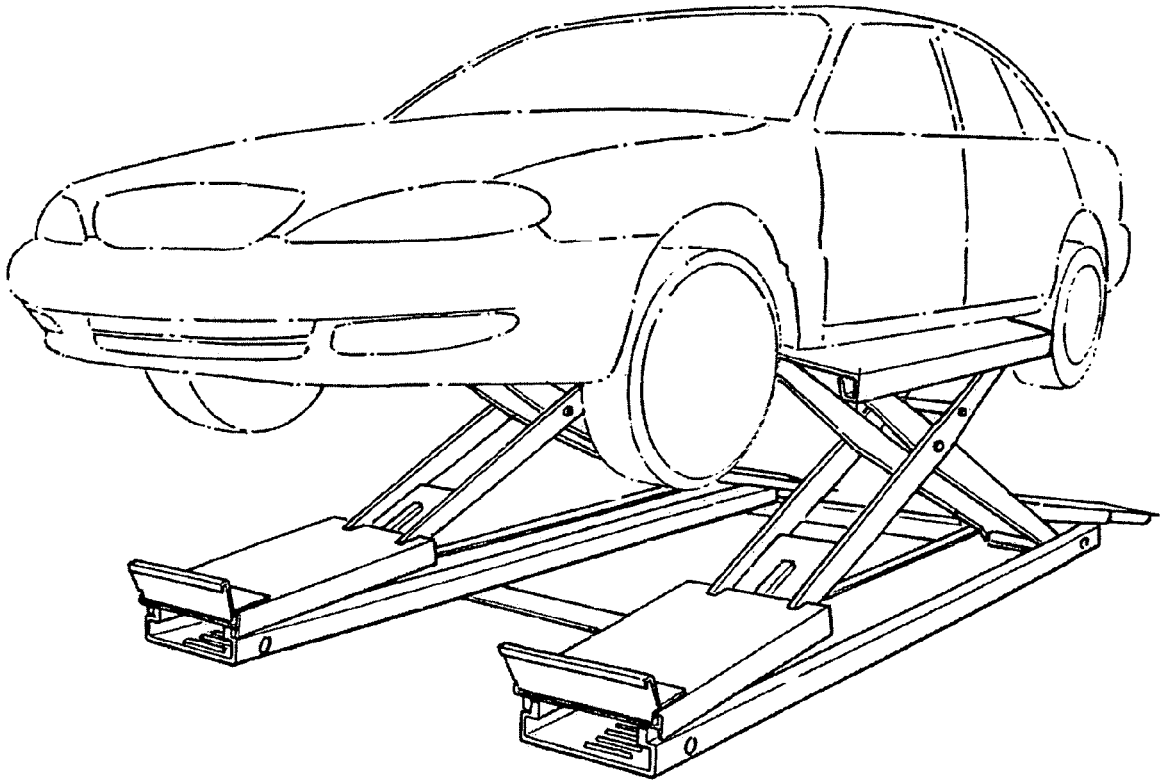
FIG. 1 is a perspective view showing one example of a conventional hydraulic lift jack apparatus.
Figure 2:
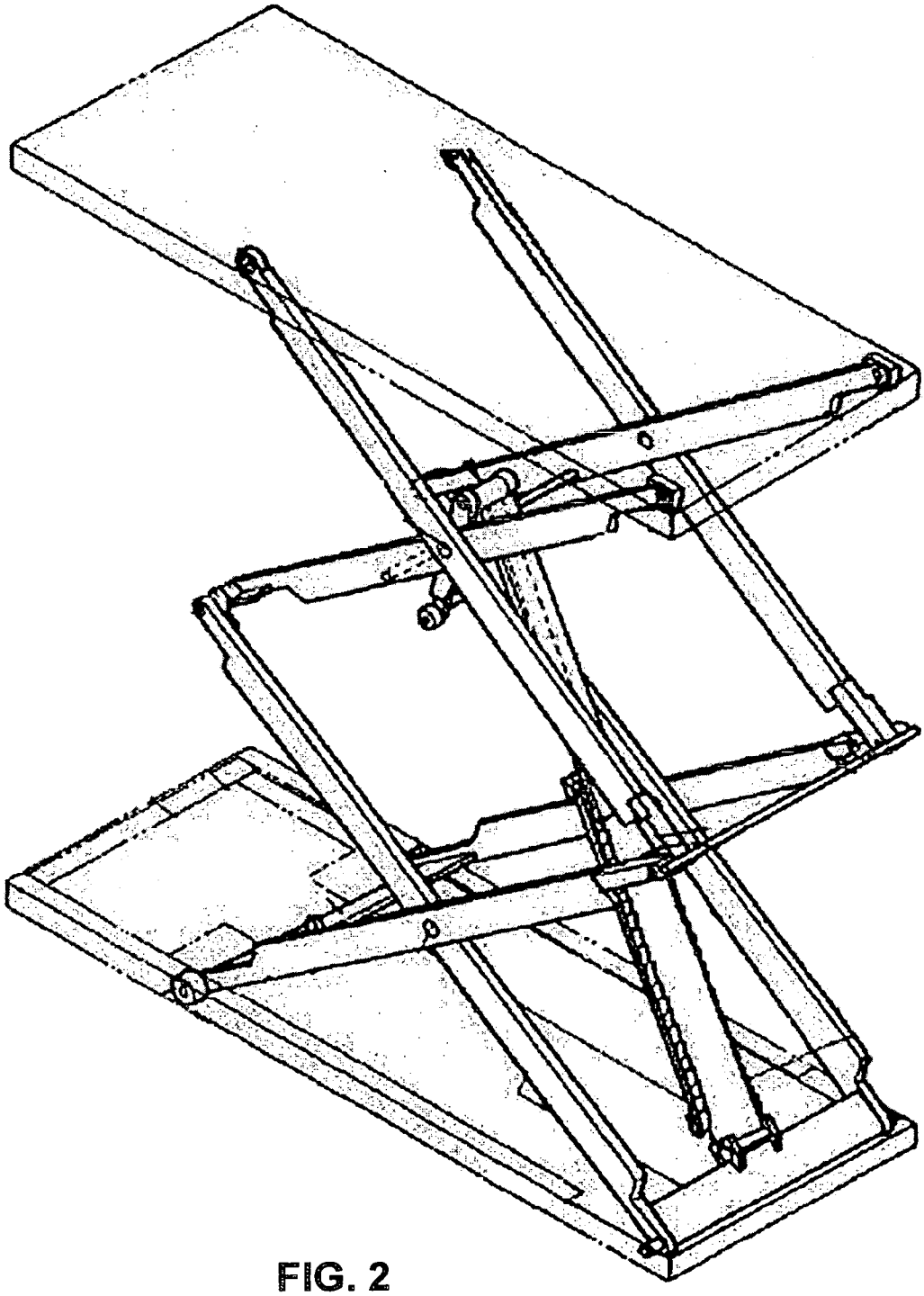
FIG. 2 is also a perspective view showing another example of a conventional hydraulic lift jack apparatus.

Hereinafter, preferred embodiments of the present invention will be described with reference to the accompanying drawings. In the following description and drawings, the same reference numerals are used to designate the same or similar components, and so repetition of the description on the same or similar components will be omitted.

Figure 3:
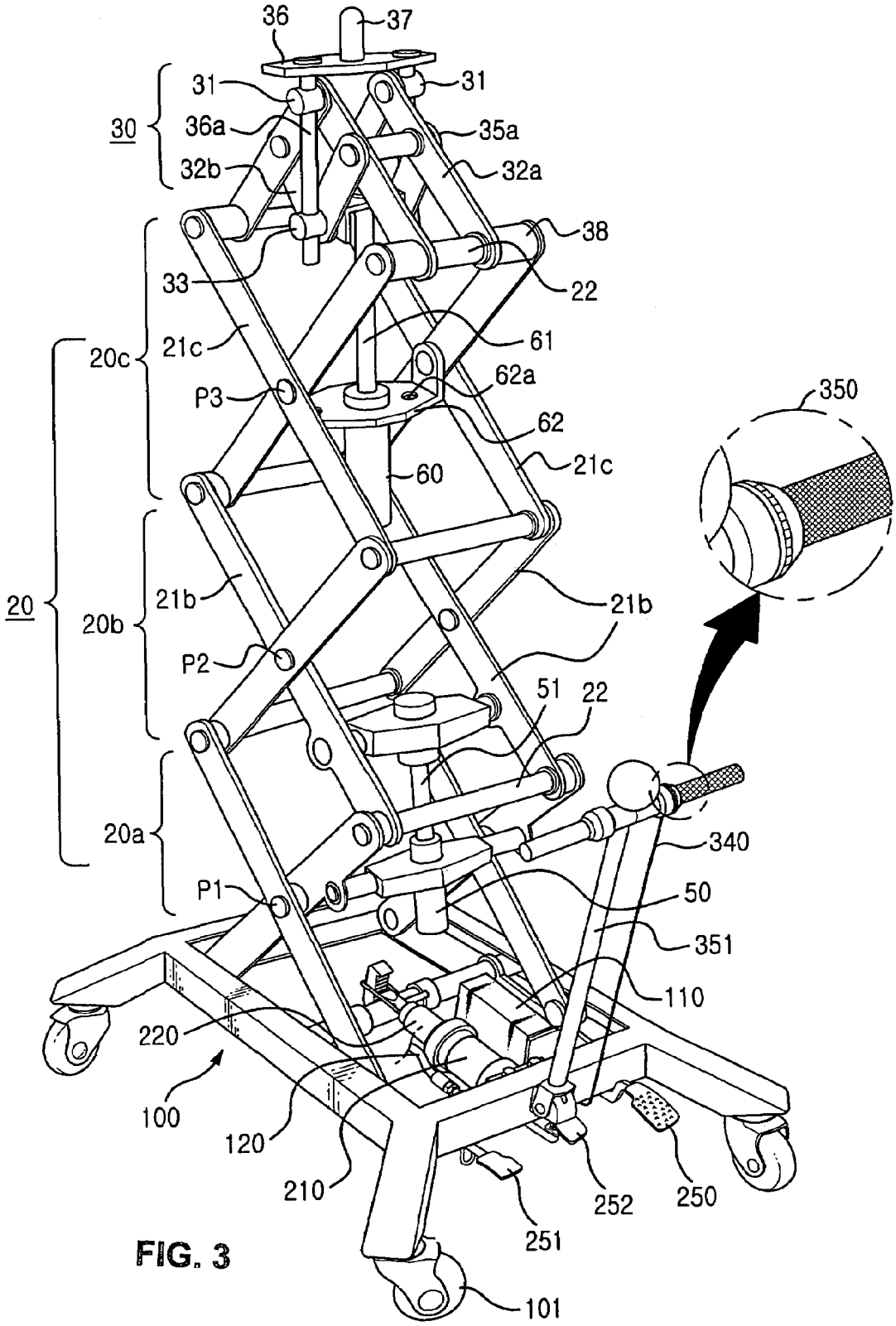
FIG. 3 is a perspective view showing a cylinder apparatus for a hydraulic lift jack with a transmission device according to the present invention.

Referring now to FIG. 3, the cylinder apparatus for the hydraulic lift jack with the transmission device is largely comprised of lifting means, fluid pumping means, and transmission means for pumping.

In the lifting means, a lift portion 20 is comprised of lift links 20*a*, 20*b*, and 20*c* pivot-engaged with each other in multi-stage type to move up and down concurrently, the lift links 20*a*, 20*b*, and 20*c* respectively being constructed of a pair of x-shaped beams 21*a*, 21*b* and 21*c* spaced at predetermined distance so that they can ascend and descend vertically from a base frame 100. A supporting portion 30 is an upper end portion of the lift portion 20 on which a supporting plate (not shown) is detachably engaged with, the supporting plate being detachably installed on the lift portion 20.

The fluid pumping means is comprised of a base frame 100, an oil tank 110 installed on the base frame 100 and containing the fluids, a pumping pedal 250 for pumping the fluids contained inside of the oil tank 110, and a pedal 251 for removing the produced hydraulic pressure.

Figure 4A:
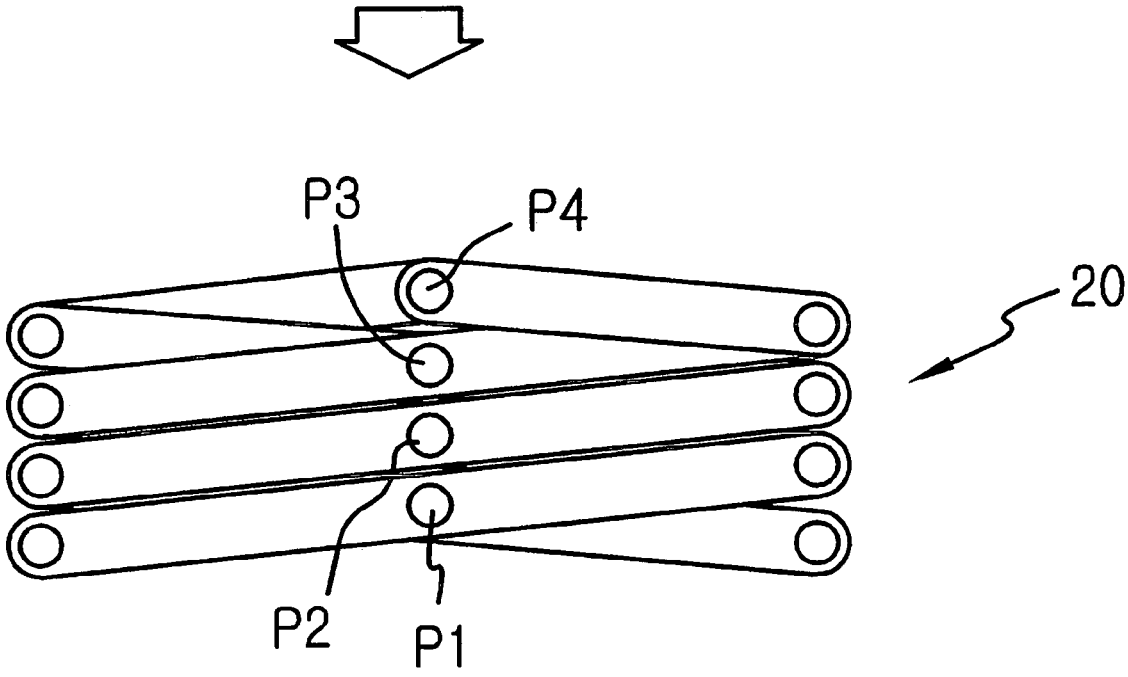
FIG. 4*a* is a side view showing a descended state of a lift link in the cylinder apparatus for the hydraulic lift jack with the transmission device according to the present invention.
Figure 4B:
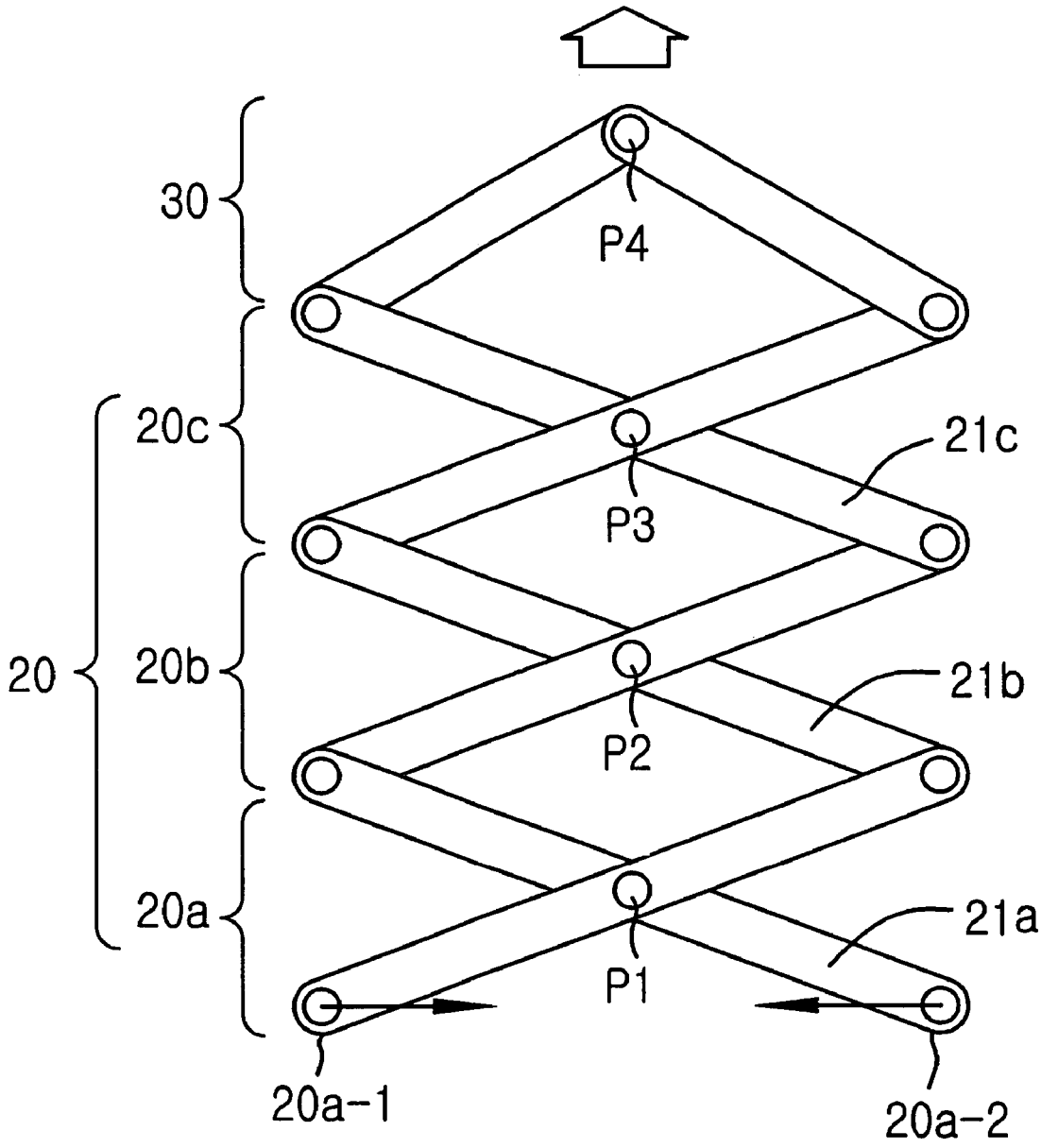
FIG. 4*b* is a side view showing an ascended state of the lift link in the cylinder apparatus for the hydraulic lift jack with the transmission device according to the present invention.

Further, referring now to FIGS. 4*a* and 4*b*, they are views illustratively showing an ascending and descending principle of the lift portion and showing the X-shaped beams constituting the lift portion, in which FIG. 4*a* is a side view showing a descended state of a lift portion 20 of the present invention, and FIG. 4*b* is a side view showing an ascended state of the lift portion 20 constituting the cylinder apparatus of the present invention.

As shown in the drawings, the lift portion 20 is constructed by crossing metallic stick type beams to form x-shaped beams 21*a*, 21*b*, and 21*c* and connecting pivot axes p1~p4 pivotably at crossing places, so that upper and lower free ends of the beams can be rotated in the direction becoming nearer or farther with centering the pivot axes p1~p4.

As for the x-shaped beams 21*a*, 21*b*, 21*c*, the X-shaped beams are installed in such a fashion as to be separated from each other and to form respective pair, and any of two x-shaped beams 21*a*, 21*b*, and 21*c* are connected pivotably by a connection member 22 to form respective lift link 20*a*, 20*b*, 20*c*.

Accordingly, when any one of the x-shaped beams 21*a*, 21*b*, 21*c* which constitute the lift link 20*a*, 20*b*, 20*c* is rotated with centering the pivot axes p1~p4, the whole lift portion 20 is operated concurrently.

The lift portion 20 is operated to ascend by the extension of the piston rod which is pushed by the fluids flowed in when the fluids are supplied by pumping in the oil tank 110.

Figure 5A:
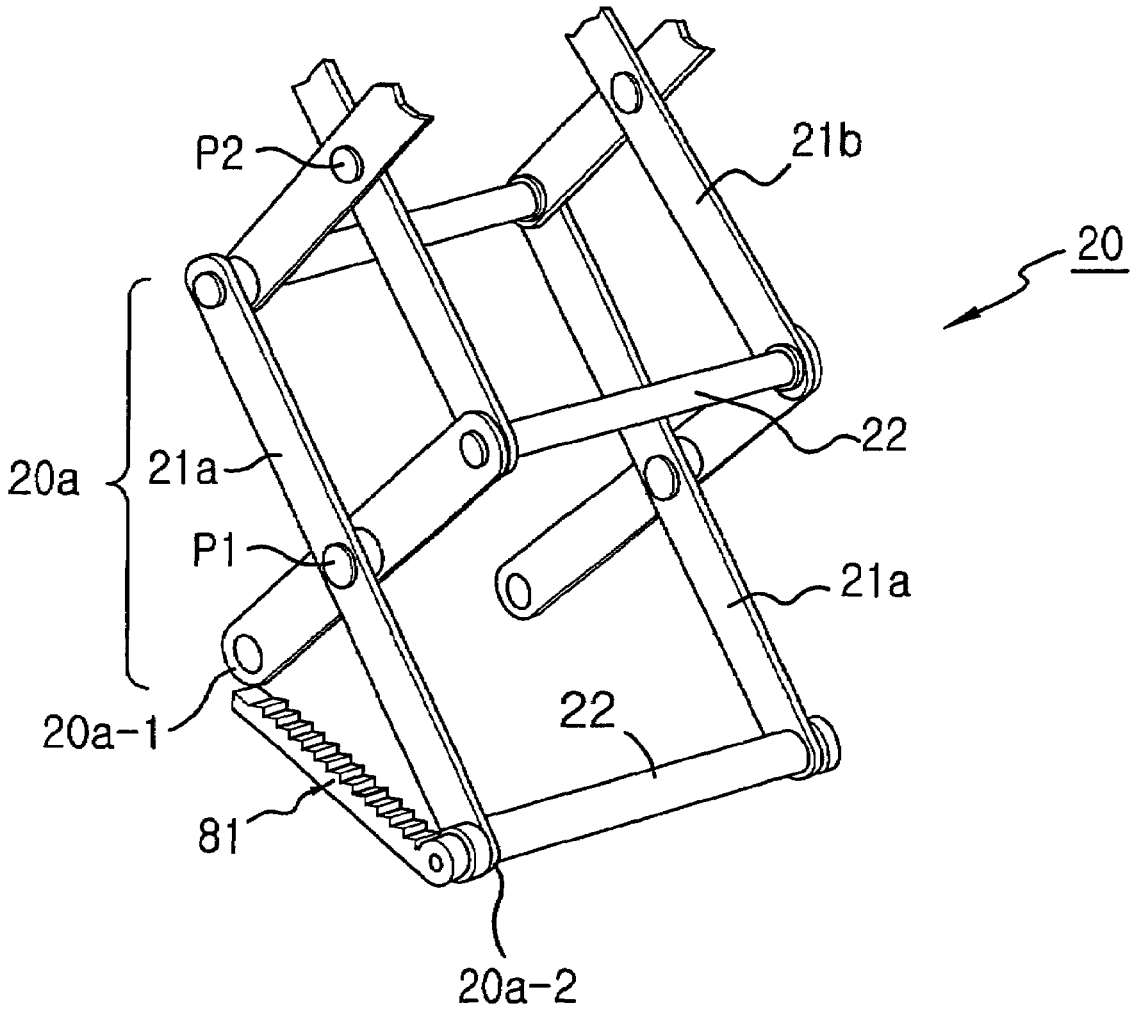
FIG. 5*a* is a perspective view of a principal portion of a lift portion showing an operated state of an X beam in the cylinder apparatus for the hydraulic lift jack with the transmission device according to the present invention.

As for an example of such operation, as shown in FIG. 5*a*, one side end of the both free ends of the x-shaped beams of the lower lift link 20*a* is secured to inside surface of the base frame 100 pivotably to form a fixed end 20*a*-1, the other free end is located above the surface of the base frame 100 to form a movable end 20*a*-2 so that it can move along the surface of the base frame 100, and those ends are connected by the connection member 22 installed pivotably between the pair of x-shaped beams 21*a*, so that the lift links 20*a*, 20*b*, and 20*c* are rotated to ascend with centering the pivot axes p1~p4 when the fluids are flowed in from the oil tank 110.

In the present invention, although the number of the lift link constituting the lift portion 20 can be selectively adjusted by the manufacturer, according to the preferred embodiment of the present invention, the lift links can be constructed of three stages, as shown in the drawings.

Figure 5B:
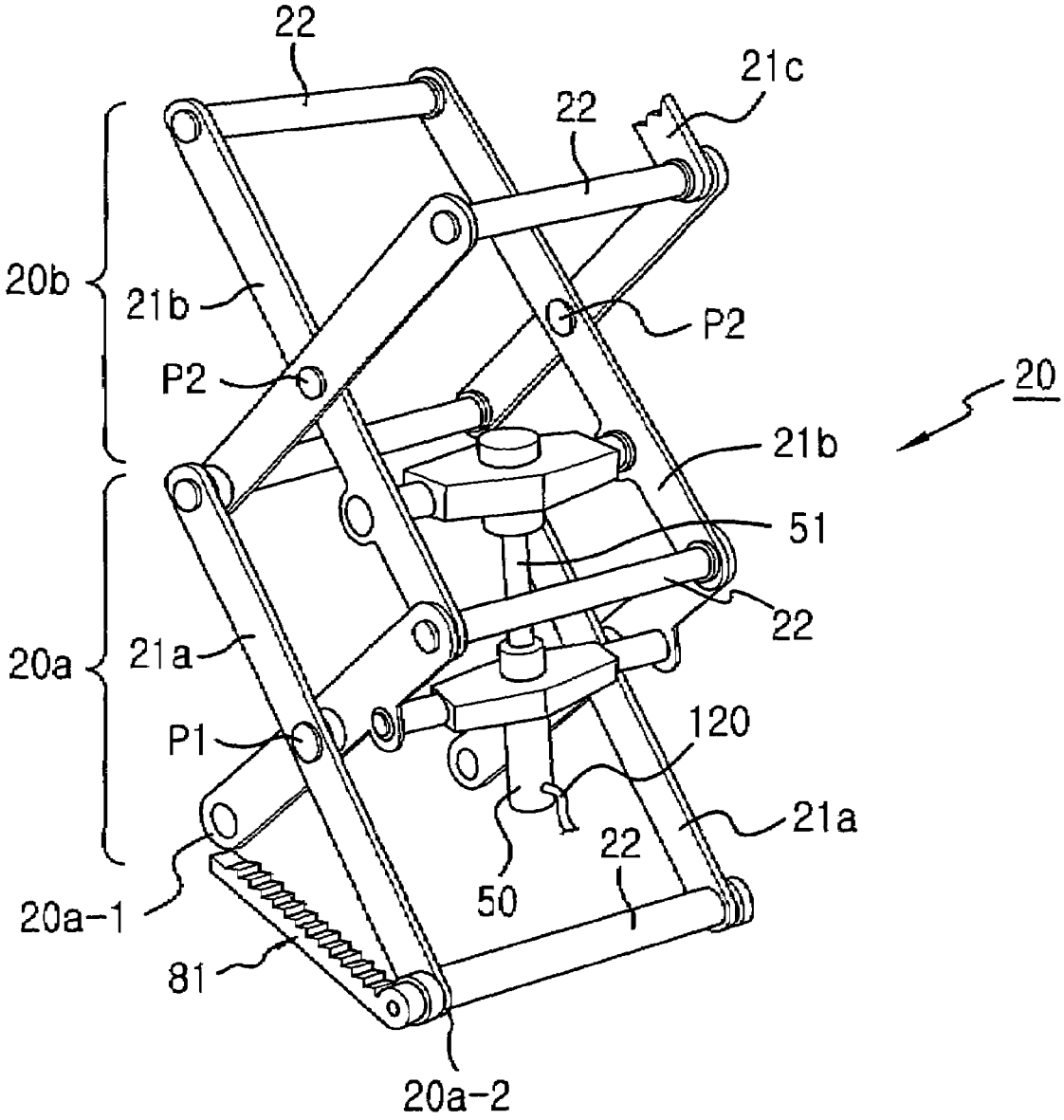
FIG. 5*b* is a perspective view of a principal portion of a lift portion showing an example of the first assistant hydraulic cylinder installed in the cylinder apparatus for the hydraulic lift jack with the transmission device according to the present invention.
Figure 5C:
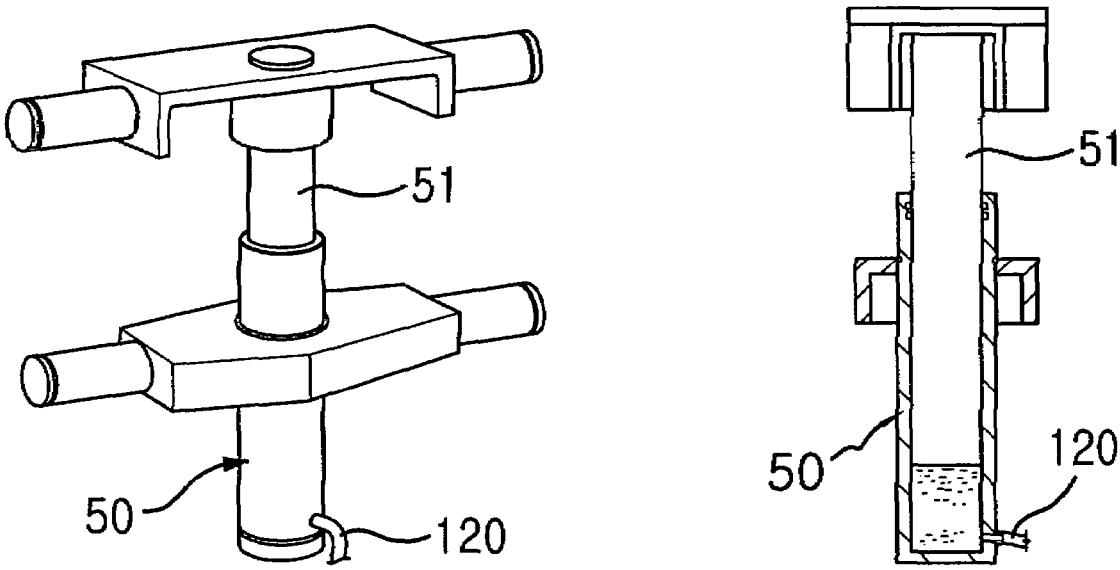
FIG. 5*c* is a perspective view of the first assistant hydraulic cylinder installed in the cylinder apparatus for the hydraulic lift jack with the transmission device according to the present invention.

Further, as shown in FIG. 5*b*, the first assistant hydraulic cylinder 50 can be installed pivotably between the x-shaped beam 21*a* and the x-shaped beam 21*b*.

Figure 6:
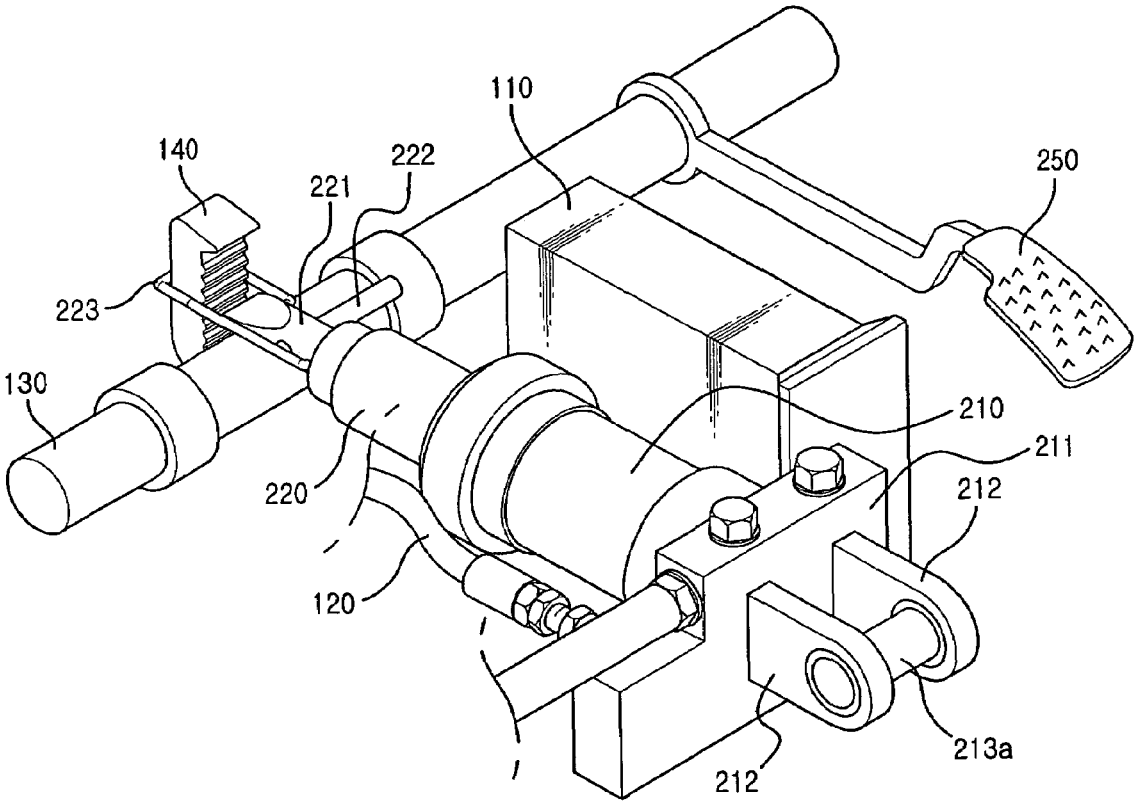
FIG. 6 is a perspective view showing fluid pumping means in the cylinder apparatus for the hydraulic lift jack with the transmission device according to the present invention.

Referring now to FIG. 3 and FIG. 6, the base frame 100 is engaged with the oil tank 110 by the main hydraulic cylinder 210 and the lift portion 20, and can be moved by a wheel 101 installed at bottom surface of it.

The lift portion 20 is fabricated by crossing the x-shaped beams, and connecting the other x-shaped beams pivotably at the ends of them such that they are spaced apart from each other by a predetermined distance, as a result, the pair of x-shaped beams can move up and down concurrently. Such x-shaped beams are constructed to be multi-stage type, and the assistant hydraulic cylinders 50, 60 are pivotably engaged between the respective x-shaped beams so that the lift portion 20 can move upwardly by the extension of the piston rod.

When the pressure of the main hydraulic cylinder 210 is removed, the oil in the assistant hydraulic cylinder 50, 60 is discharged through the oil hose to return to the oil tank 110, and the hydraulic cylinder 50, 60 moves downward to result in the overlap of the x-shaped beams.

As shown in FIG. 3 and FIG. 6, the fluid pumping means of the present invention is comprised of the main hydraulic cylinder 210 for in-taking the oil stored in the oil tank 110 installed inside of the base frame 100 and pumping it to the outside, and a piston 220 installed inside of the hydraulic cylinder 210 so that it can move forwardly and rearward.

Also, in the present invention, the transmission means for the pumping is comprised of a transmission control portion installed outside of the fluid pumping means to control the pumping volume of the fluids to thereby control the ascending velocity progressively, and a pressure removing portion for the piston for removing the hydraulic pressure produced in the cylinder by the transmission control portion and again supplying a little volume of the fluids.

In other words, the fluid pumping means is provided with a cylinder support frame 211 at one side of the base frame 100, which can rotate with centering the first connection shaft 213*a*, and the main hydraulic cylinder 210 at the front of the cylinder support frame 211 for transferring the hydraulic pressure to the lift portion 20 after in-taking the oil from the oil tank 110.

The piston 220 for pumping fluids by adjusting the volume of fluids based on the length of it is installed inside of the main hydraulic cylinder 210, and a piston head 221 equipped with a piston pin 222 at one side is installed at the front end of the piston 220.

Further, a piston holding jaw 223 is installed at a transmission control member 140 provided slant at the center of the fixed shaft 130 outside of the piston head 221 for engaging with the piston 220.

Figure 7A:
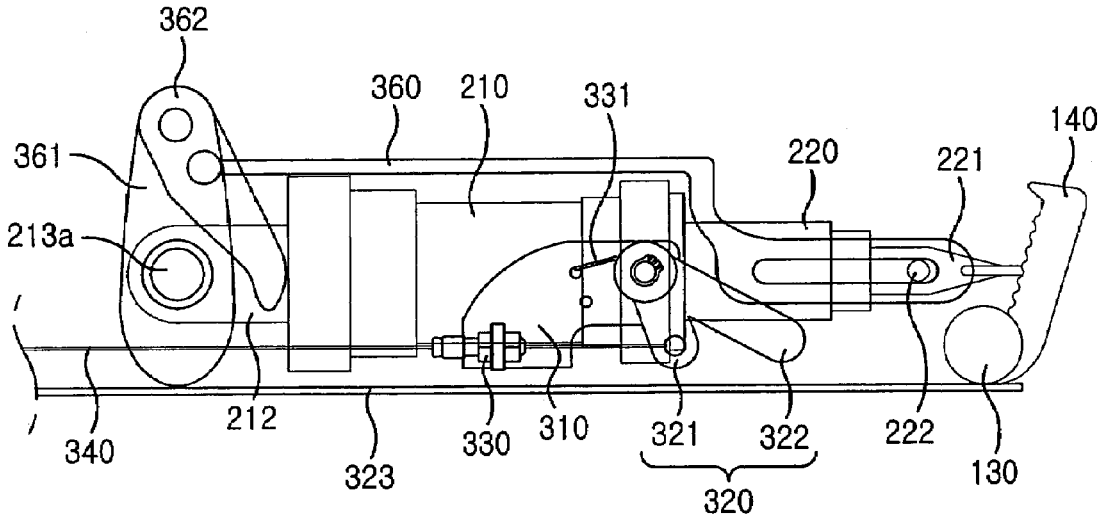
FIGS. 7*a* to 7*c* are side views illustratively showing the operation of a transmission control portion in the cylinder apparatus for the hydraulic lift jack with the transmission device according to the present invention.
Figure 7B:
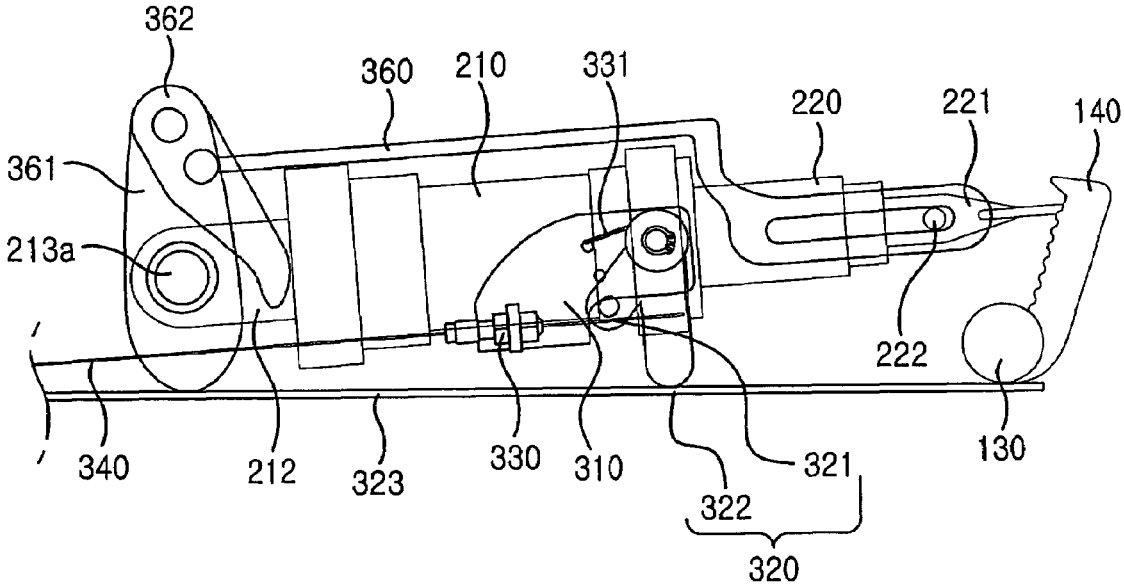

Meanwhile, as shown in FIG. 7*a* and FIG. 7*b*, the transmission control portion of the pumping transmission means is provided with a transmission lever 350 for tensioning or relieving a transmission wire 340 at the upper end of a lever supporting member 351 installed at one side of the base frame 100, a securing base 310 is attached at one side of the main hydraulic cylinder 210, and a supporting member 320 is rotatably installed at one side of the securing base 310 for moving the main hydraulic cylinder 210 and the piston 220 up and down by tensioning and relieving the transmission wire 340 connected to the transmission lever 350.

A wire securing member 321 to which the transmission wire 340 is secured after passing through a wire supporting member 330, is provided at one side of the supporting member 320, and also a cylinder supporting member 322 is provided at one side of the supporting member for moving the main hydraulic cylinder 210 and the piston 220 up and down in such a fashion that they are erected vertically when they are tensioned by the transmission wire 340 and they are laid down horizontally when they are relieved by the transmission wire 340. The other side of the supporting member 320 is engaged rotatably with the upper end of the securing base 310 by a spring 331 for the supporting member.

Figure 8A:
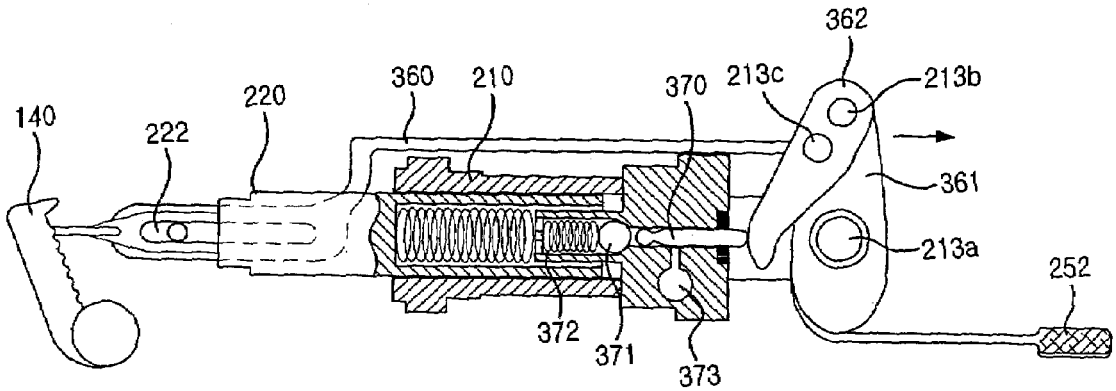
FIG. 8*a* and FIG. 8*b* are side views showing the operation of a removing portion for the hydraulic pressure in the cylinder apparatus for the hydraulic lift jack with the transmission device according to the present invention.
Figure 8B:
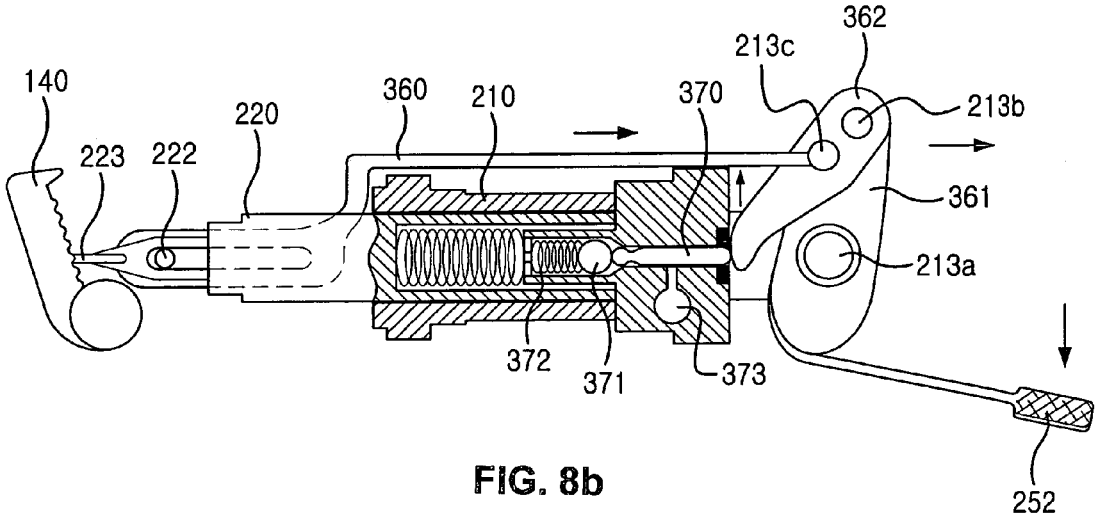
Figure 9:
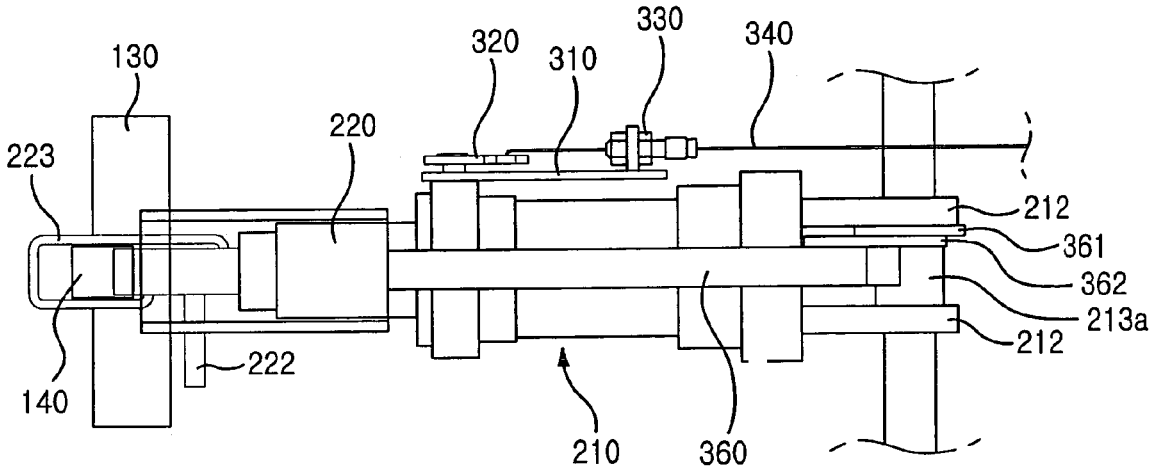
FIG. 9 is a planar view of the fluid pumping means in the cylinder apparatus for the hydraulic lift jack with the transmission device according to the present invention.

Referring now to FIGS. 8*a*, 8*b* and 9, the oil pressure removing portion for the piston of the pumping transmission means is provided with first press member 361, which is operated to reduce the length of the extended piston 220 by actuating the transmission lever 350, and is rotated outwardly from the first connection shaft 213*a* when the pedal 252 is actuated for removing the pressure in the piston.

Also, second press member 362 is provided for rotating upwardly with centering the second connection shaft 213*b* and coupled with the first press member 361 at the pressure removing portion, and a piston rotating member 360 is also provided above the main hydraulic cylinder 210 for moving the piston 220 to the inside of the main hydraulic cylinder 210 by being operated with centering the third connection shaft 213*c* and coupled with the second press member 362.

In addition, a pressure removing member 370 is provided at lower front side of the second press member 362 for returning the fluids into the oil tank 110 via a gap produced by pushing a piston hydraulic ball 371, which blocks the fluid path due to the pressing of the second press member 362, the fluids discharged by the pressure removing member 370 returns to the oil tank 110 via fluid recovery hole 373.

Further, the piston hydraulic ball 371 is seated safely at one side of the pressure removing member 370 for blocking or allowing the flow of the fluids, and a spring 372 is installed for returning the piston hydraulic ball 371 to its initial position when the pressure removing member 370 is returned to its initial position.

The operation of the fluid pumping means and the pumping transmission means in the cylinder apparatus for the hydraulic lift jack with the transmission device of the present invention as constructed above will be described below.

As shown in FIGS. 3, and 7*a* to 7*c*, when the pedal 250 for pumping the fluids is pressed to ascend the lift portion 20 at slow velocity at first, the lift portion 20 is ascended slowly according to the pumping of the fluids by the main hydraulic cylinder 210 and the piston 220.

Then, it is necessary to increase the volume of fluids supplied by using the transmission means so that the lift portion 20 can ascend urgently. At first, the transmission wire 340 can be tensioned when the transmission lever 350 installed at the supporting member 351 is rotated, then the cylinder supporting member 322 installed at one side of the main hydraulic cylinder 210 is erected vertically to be laid on a base 323 for the supporting member.

When the cylinder supporting member 322 is erected vertically, the main hydraulic cylinder 210 and the piston 220 ascend at the same time, and the piston head 221 installed at front end of the piston 220 and the piston holding jaw 223 engaged with the piston 220 ascend along the transmission control member 140 so that the length of the piston 220 becomes extended.

Figure 7C:
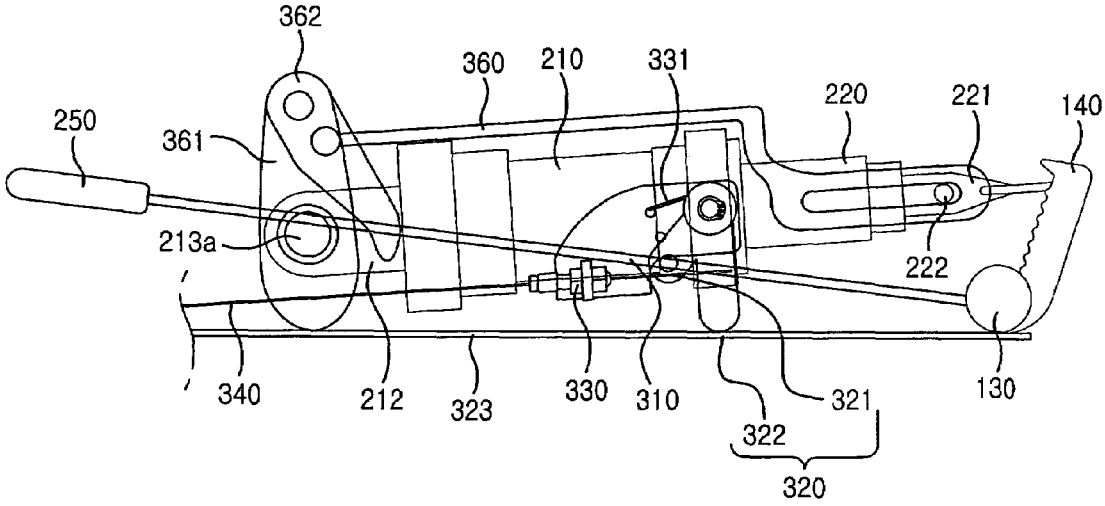

As shown in FIG. 7*c*, when the pedal 250 for pumping fluids is pressed strongly again under the extended state of the piston 220, the fixed shaft 130 and the transmission control member 140 connected to the pedal moves toward the piston 220 and at the same time the piston 220 moves to the inside of the main hydraulic cylinder 210 to pump the fluids. As a result, more volume of fluids is supplied to the lift portion 20 as long as the piston extends, as a result, the lift can ascend as fast as possible. If it is required to ascend the lift portion at low velocity under the ascended state of the lift portion 20, as shown in FIGS. 3 and 7*a*, the transmission wire 340 is relieved by rotating the transmission lever 350 reversely, then the cylinder supporting member 322 is laid down horizontally by means of the elasticity of the spring 331 of the supporting member, as a result, the main hydraulic cylinder 210 and the piston 220 are lowered. In this instance, the length of the piston 220 is maintained to be as it has been.

Then, as shown in FIG. 3 and FIG. 8*b*, when the pedal 252 for removing the pressure of the piston is pressed, the first press member 361 rotates outwardly with centering the first connection shaft 213*a*, the second press member 362 rotates upwardly with centering the second connection shaft 213*b* and coupled with the first press member 361, and the piston rotation member 360 is actuated with centering the third connection shaft 213*c* and coupled with the second press member 362 to thereby move the piston 220 to the inside of the main hydraulic cylinder 210.

In this instance, the second press member 362 presses the pressure removing member 370 to push the piston hydraulic ball 371 blocking the fluid path so that it can produce the gap and return the fluids into the oil tank 110 via it.

As described above, the transmission lever 350 is operated to retract the piston 220 to thereby remove the pressure in the piston.

Then, when the pedal 250 for pumping the fluid is pressed again, the lift portion ascends slowly because the pumping volume of the fluids becomes reduced as the piston retracts.

Hereinafter, the flow path of the fluid will be described below according to the operation of the cylinder apparatus of the hydraulic lift jack with the transmission device of the present invention.

Figure 10:
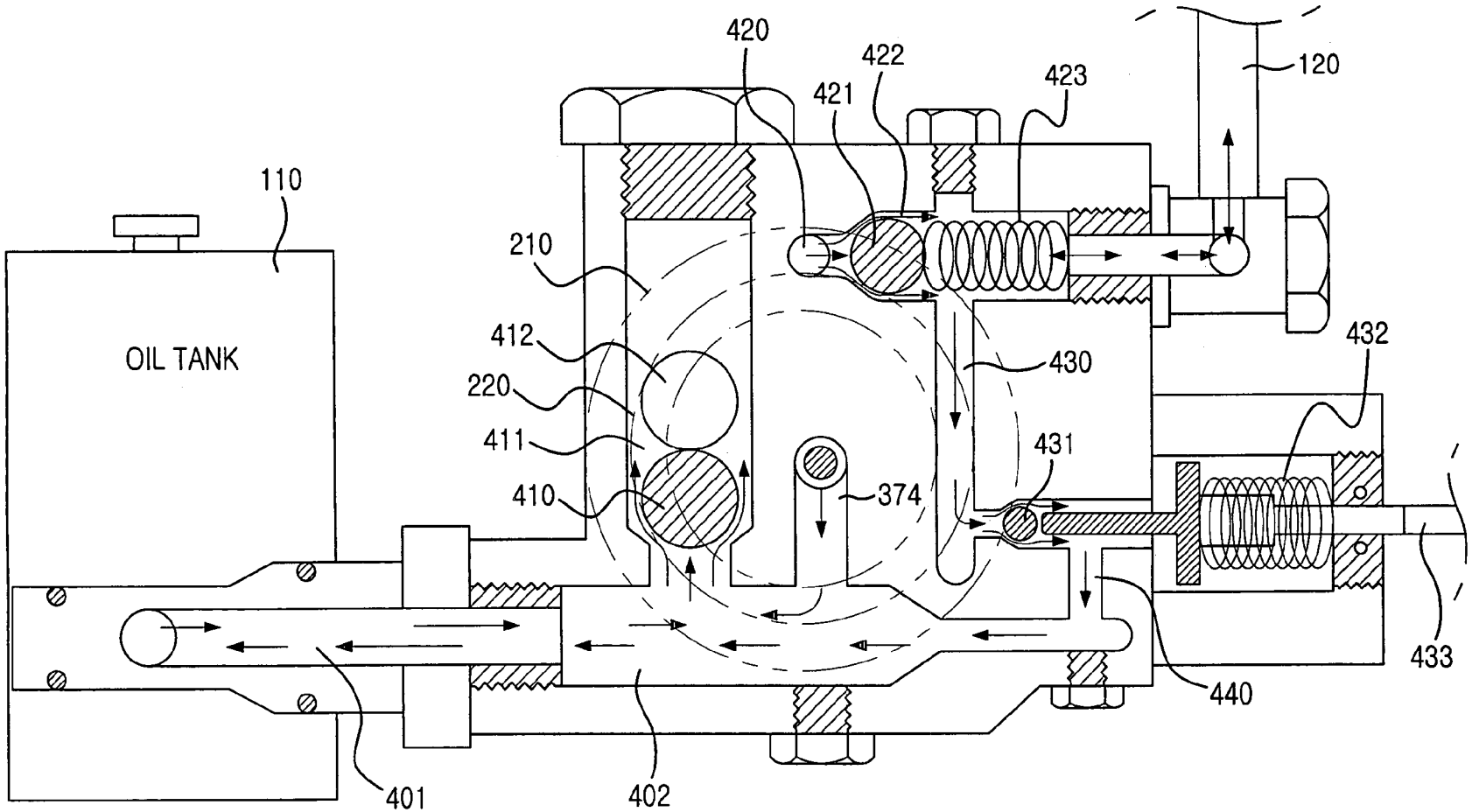
FIG. 10 is a cross-sectional view showing the flow of the fluids in the cylinder apparatus for the hydraulic lift jack with the transmission device according to the present invention.

As shown in FIG. 3 and FIG. 10, when the pedal 250 for pumping the fluids is pressed to ascend the lift portion 20, the oil stored in the oil tank 110 flows between the first hydraulic ball 410 via the first main hydraulic path 401 and the second main hydraulic path 402 to move into the first hydraulic path 411, and the oil passes through the second hydraulic ball 421 via the first hydraulic hole 412 and the second hydraulic hole 420 into the second hydraulic path 422, and then it is supplied to the lift device 500 via the oil hose 120.

Here, the drawing numeral 423 represents for the second spring, which is operated to push the second hydraulic ball 421 to thereby block the second hydraulic hole 420 by the elasticity when the oil is not further come out from the second hydraulic hole 420.

Meanwhile, when the pedal 251 for removing the fluids is pressed to lower the lift portion 20, as the supporting member 433 for removing the oil pressure is moved backward to retract the third hydraulic ball 431, the oil in the lift portion 20 flows along the oil hose 120 to come down to the second hydraulic path 422, it flows into the third hydraulic path 430 as the second hydraulic hole 420 is blocked by the second hydraulic ball 421, and then the oil come into the third hydraulic path 430 flows along the third hydraulic ball 431 to pass through the fourth hydraulic path 440 to result in returning to the oil tank 110.

Here, the drawing numeral 432 represents for the third spring, which is operated to block the oil path by the third hydraulic ball 431 to thereby prevent the oil from flowing into the fourth hydraulic path 440 by returning the retracted supporting member 433 for removing the oil pressure to its initial position when the oil pressure is removed.

Also, when the pedal 252 for removing the pressure is pressed to remove the oil pressure in the piston 220 after using the transmission means for pumping, the oil stored in the piston 220 is come out into the piston hydraulic path 374 to return to the oil tank 110 via the first and second main hydraulic path 401, 402.

Meanwhile, referring now to FIG. 11 to FIG. 15, the supporting portion 30 is characterized by comprising: a pair of arms 32*a*, 32*b* pivotably engaged with each other by a plurality of connection member 22 so that they are spaced apart from each other by a predetermined distance, in which one end of it is engaged pivotably with both free ends of the lift link 20*c*, and the other end is pivotably engaged with each other by a boss 31 formed with a through-hole 31*a*; a pair of sub-arms 35*a*, 35*b* pivotably engaged with each other by the connection member so that they are spaced apart from each other, in which one end is pivotably engaged with the arm 32*a*, 32*b*, and the other end is pivotably engaged with a boss 33 formed with a through-hole 33*a*; and, a securing member 36 provided with a guide shaft 36*a* inserted slidably into the through-hole 31*a*, 33*a* formed at the boss 31, 33, and on which the base plate is installed.

Also, one end of the arm 32*a*, 32*b* is pivotably engaged with the free end of the upper jack arm 20*c* in the lift portion 20, and the other end of the arm is pivotably engaged with the boss 31 formed with the through-hole 31*a*.

Further, the arm 32*a*, 32*b* is comprised of a pair of arms connected by a plurality of connection member 22, and a pair of sub-arms 35*a*, 35*b* having a shorter length are pivotably engaged with the pair of arms 32*a*, 32*b*. One end of the sub-arm 35*a*, 35*b* is pivotably engaged with the pair of arm 32*a*, 32*b*, and the other end is pivotably engaged with the boss 33 formed with the through-hole 33*a*.

The upper and lower two bosses 31, 33 are formed with vertical through-holes 31*a*, 33*a* into which the guide shaft 36*a* of the securing member 36 is inserted to fix the securing member 36 so that it cannot move.

The securing member 36 is provided with an engaging shaft 37 with which the base plate (not shown) loading the objects is engaged detachably.

As described above, the supporting portion 30 is moved up and down with being coupled with the movement of the lift portion 20, and the force for moving up the supporting portion can be concentrated by the engaging shaft 37.

Figure 12:
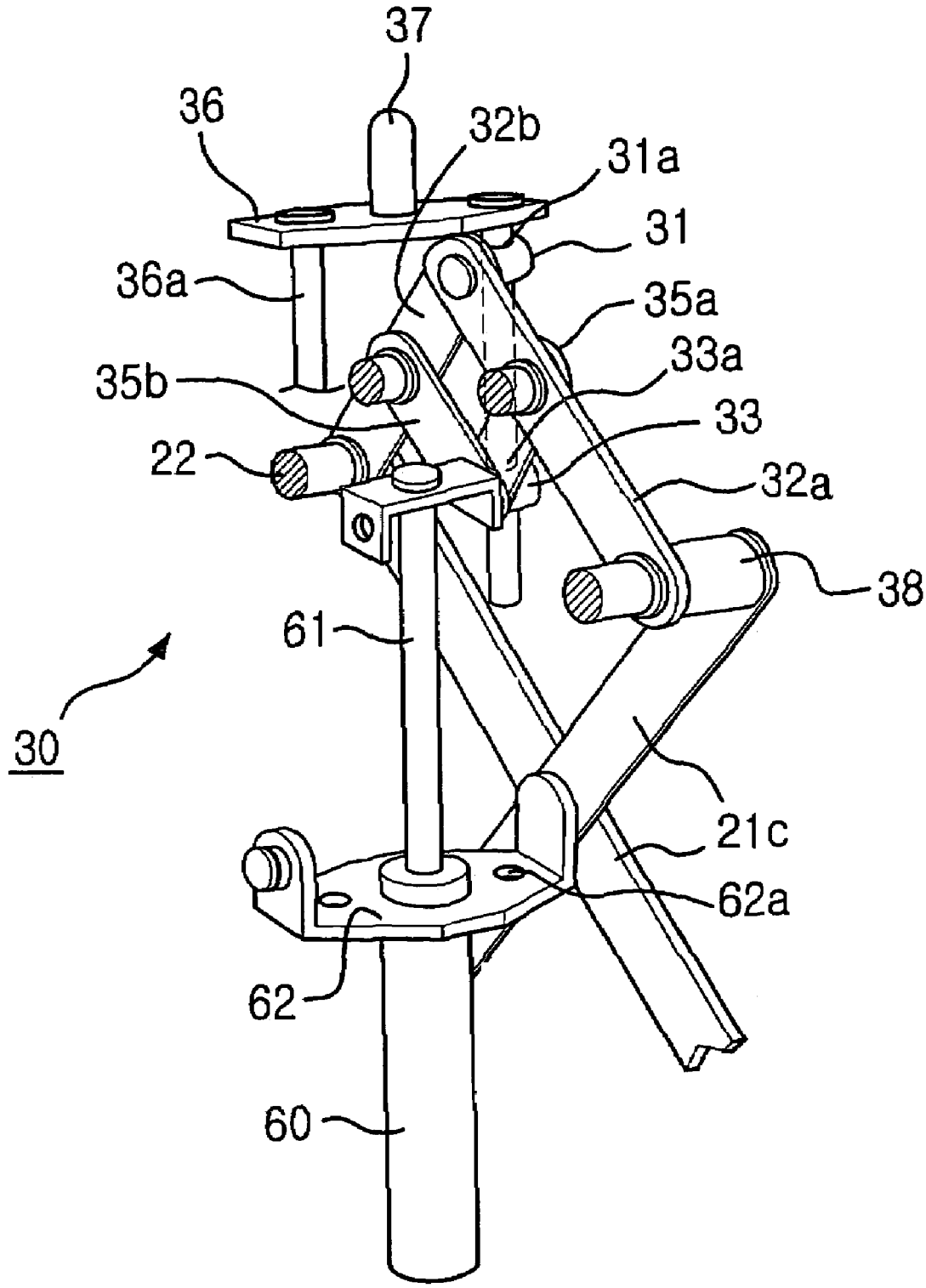
FIG. 12 is a perspective view showing the principal portion partially taken from the cylinder apparatus of the present invention to represent the constructing elements of the support portion shown in FIG. 11 more concretely.
Figure 13:
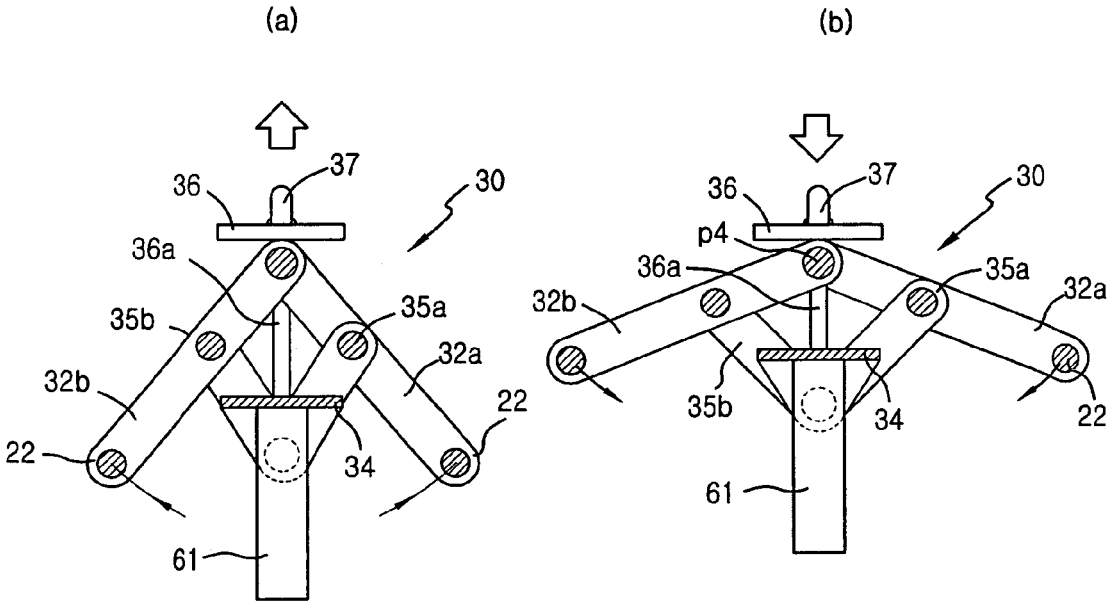
FIG. 13 is a side view showing the operation of the support portion constructing the cylinder apparatus of the present invention, in which (a) shows the operation state at the time of the ascending of the assistant hydraulic cylinder, and (b) shows the operation state at the time of the descending of the assistant hydraulic cylinder.

Meanwhile, when the supporting portion 30 is operated to move up, the supporting portion 30 can be provided with the second hydraulic cylinder 60 for moving the lift portion 20 with less force than is required in the ascending of the lift portion 20. For instance, as shown in FIG. 12 and FIG. 13, the second assistant hydraulic cylinder 60 can be rotatably engaged with the pivot axis p3 of the arm 20*c* in the lift portion 20 via a securing plate 62.

In this instance, when the oil pressure is applied to the assistant hydraulic cylinder 60 from the oil tank 110, the end of the piston rod 61 of the second assistant hydraulic cylinder 60 is extended to push up a movable plate 34 pivot-engaged with the boss 33 located between the sub-arms 35*a*, 35*b*.

Figure 15:
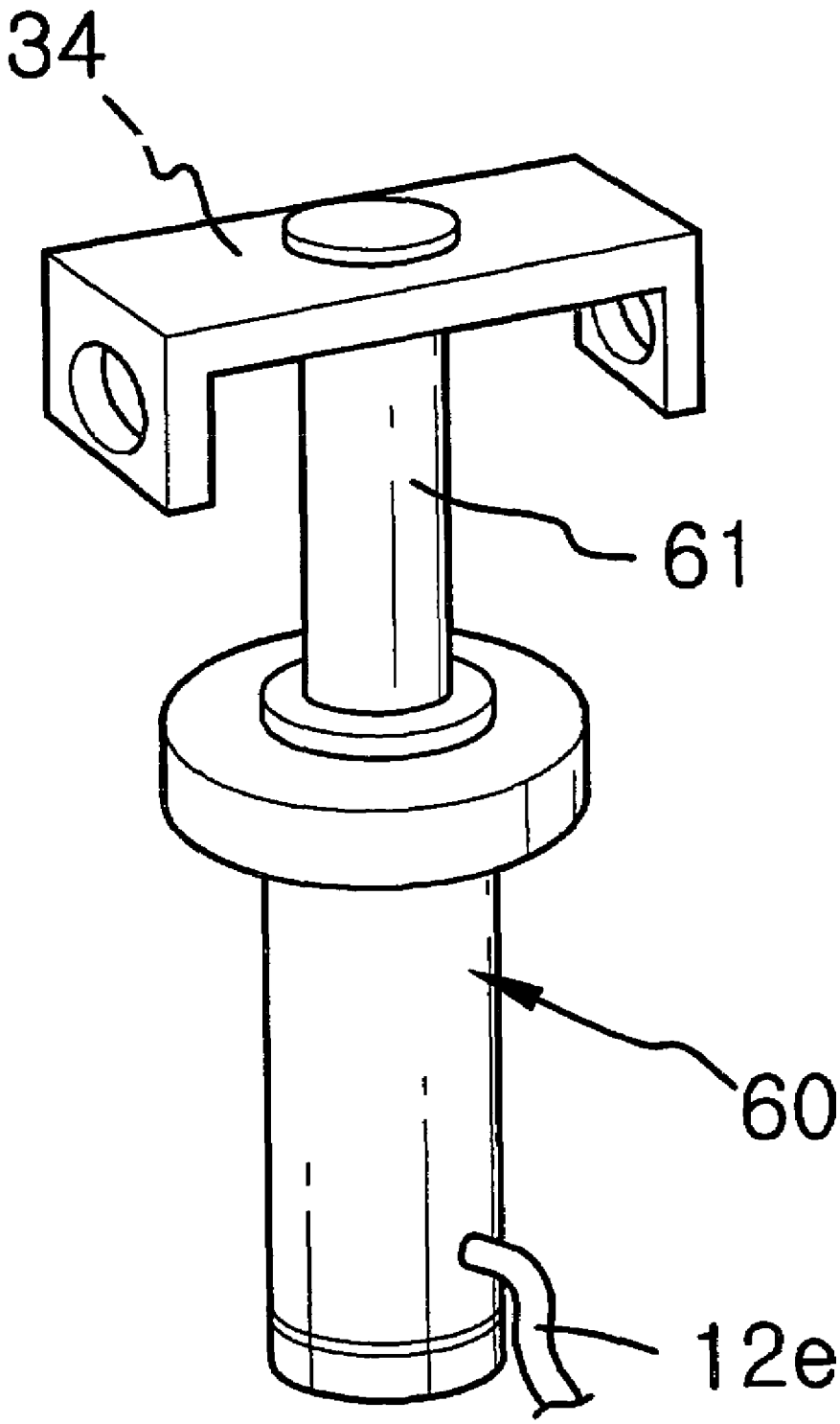
FIG. 15 is a perspective view showing the second assistant hydraulic cylinder installed in the cylinder apparatus for the hydraulic lift jack with the transmission device according to the present invention.

Accordingly, as shown in FIG. 15, when the fluid supplied from the oil tank 110 via the oil hose 120 is come into the second hydraulic cylinder 60, the piston rod 61 becomes extended to make the distance between the pivot axis p3 of the x-shaped beam 21*c* and the movable plate 34 of the sub-arm 35*a*, 35*b* farther to thereby move up the supporting portion 30. In this instance, a through-hole 62*a* through which the guide shaft 36*a* passes is further provided at the surface of the securing plate 62 so that the lift portion 20 can descend as low as possible.

Figure 14:
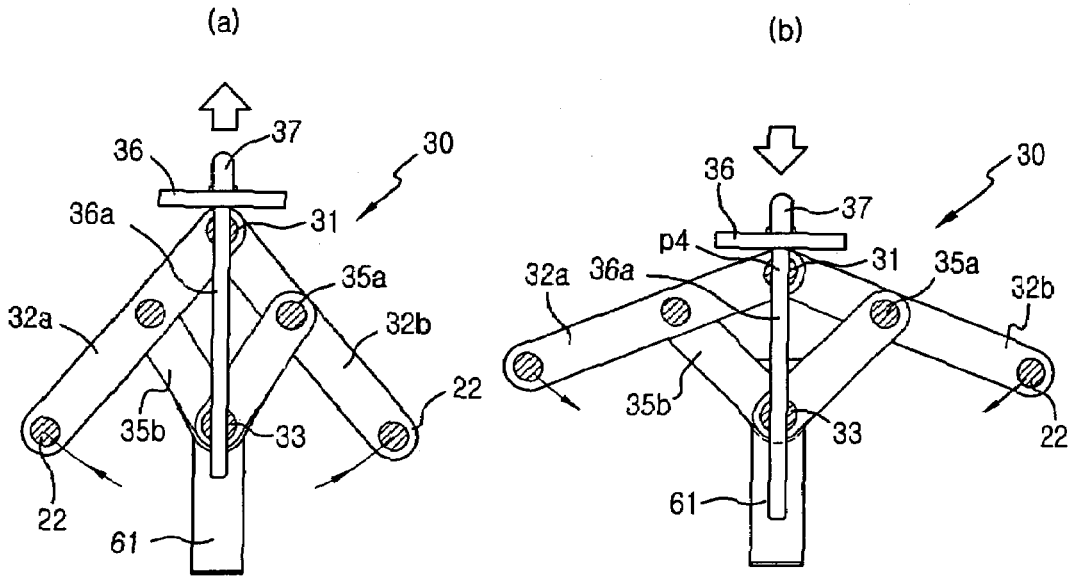
FIG. 14 is a side view of a support portion similar to FIG. 11, which is one example of the guide means for holding the support portion of the jack device so that it can ascend and descend vertically, in which FIG. 14(*a*) is showing a descending state of a support member, and FIG. 14(*b*) is showing an ascending state of the support member.

Therefore, as shown in FIG. 14, the guide shaft 36*a* inserted into the upper and lower through-holes 31*a*, 33*a* moves slidably up and down through the through-holes 31*a*, 33*a* in the vertical direction without shaking to the right or left, so that the supporting portion 30 can safely transport the loaded object vertically.

Figure 11:
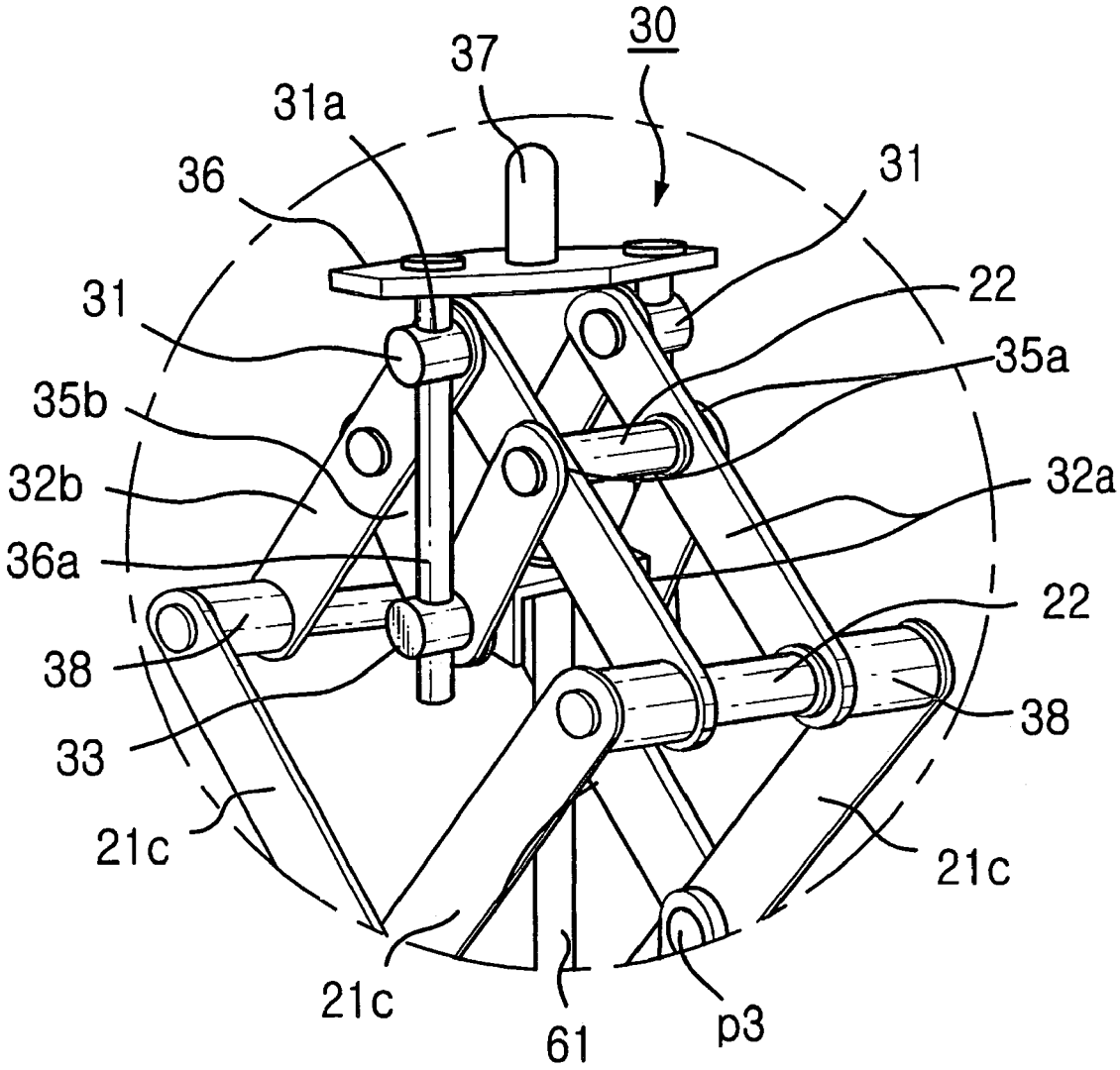
FIG. 11 is a perspective view of the principal portion showing a support portion in the cylinder apparatus for the hydraulic lift jack with the transmission device according to the present invention.

Drawing numeral 38 in FIG. 11 is a spacer, which is operated to reduce the height of the respective x-shaped beam 21*a*, 21*b*, 21*c*, which is installed as multi-stage type, to be the lowest at the maximum by overlapping them to cross each other, when the lift portion 20 is lowered.

It will be appreciated that the lift portion can be moved up and down by installing both the first and second assistant hydraulic cylinders 50, 60, which are operated by the fluids supplied from the oil tank 110, or by installing any one of the assistant hydraulic cylinders 50, 60 separately.

Accordingly, it will be appreciated that those skilled in the art can easily change the installment position of the cylinder by using the operation principle of the cylinder.

Meanwhile, when the pedal 251 for removing the fluid is operated, it can be constructed to operate along with the operation of a safety device, that is, locking and unlocking means, for blocking the downward movement of the lift portion 20 physically, which will be described in detail below.

Figure 16:
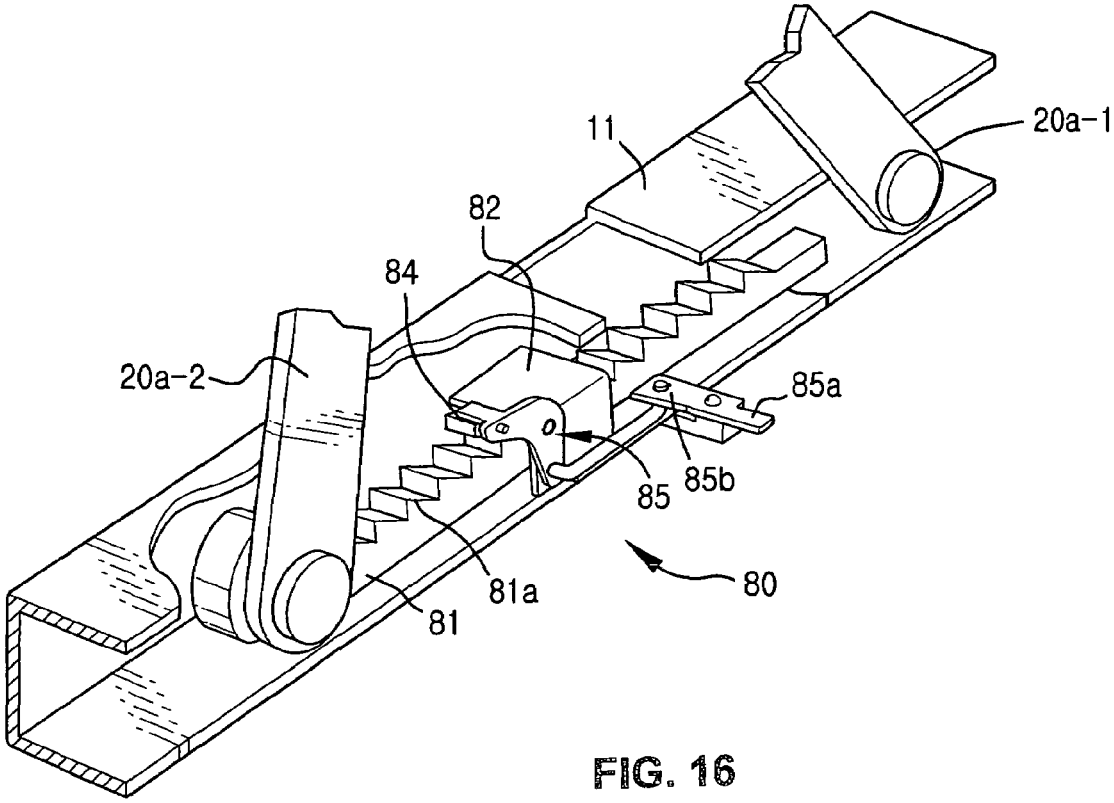
FIG. 16 is a perspective view showing an illustrative example of a locking and unlocking means installed in the cylinder apparatus for the hydraulic lift jack with the transmission device according to the present invention.

Referring to FIG. 16, it shows a perspective view for the selected constituting elements of the locking and unlocking means according to the present invention.

The locking and unlocking means 80 is operated to prevent a safety accident from occurring at the time of unexpected downward movement of the lift portion 20, which is caused by the puncture of sealing members provided within the cylinder and the oil tank 110 due to the load pressure of the object applied to the lift portion 20 ascended by the oil pressure supplied from the oil tank 110, and the momentary coming out of the oil pressure caused by the puncture. It features that the locking means is previously operated to be unlocked before the pedal 251 is activated to remove the oil pressure.

As shown in FIG. 3 and FIG. 16, the locking and unlocking means 80 is comprised of a locking lever 81 having a desired length and is pivotably engaged with movable end 20*a*-2 of the x-shaped beam installed inside of the base frame 100, and in which an one-way latchet 81*a* is installed; an elastic poll 84 engaged rotatably with a bracket 82 installed at the base frame 100, and is operated to engage with the latchet 81*a* by a spring; and a coupling member 85 operated for relieving the poll 84 from the latchet 81*a* by the operation of the pedal 251 for removing the fluid.

One end of the locking lever 81 is pivotably engaged with a lower movable end of the jack arm 20*a* in the lift portion 20 so that it can move on the surface of the base frame 100 at the time of the movement of the movable end.

The bracket 82 is secured to the base frame 100 to rotatably support the poll 84. The poll 84 is rotatably engaged with the bracket 82 and is elastically supported by a spring (not shown) so that the distal end of it is caught by the latchet 81*a*. Accordingly, when the locking lever 81 is moved together with the movable end 20*a*-2 of the x-shaped beam 21*a* (when the lift portion 20 is ascended), the one-way latchet 81*a* can pass through the poll 84, however, when the locking lever retracts (when the lift portion 20 is descended), the poll 84 is caught by the latchet 81*a*, so that the lift portion 20 cannot descend unless the poll 84 is separated from the latchet 81*a*.

The coupling member 85 is operated to separate the poll 84 from the latchet 81*a* to unlock the poll 84 engaged with the latchet 81*a* so that the locking lever 81 can move together with the movable end 20*a*-2 when the lift portion 20 descends, and the poll 84 is linked to be separated from the latchet 81*a* and is operated to be coupled with the pedal 251 for removing the fluid at the time of downward movement of the lift portion 20.

Accordingly, the locking lever 81 can move together with the movable end 20*a*-2 of the x-shaped beam 21*a*. Also, when the lift portion 20 is operated to ascend, the lift portion cannot descend because the poll 84 is engaged with the latchet 81*a* resulting in the physical locking, in spite of the application of the load pressure of the object.

Accordingly, in the cylinder apparatus for the hydraulic lift jack with the transmission device of the present invention as described above, the cylinder apparatus is constructed that force can be concentrated on any one place of the supporting portion without some disperse of the force, so that the upper end of the jack can be accurately located on the bottom of the object to be loaded without separating parts surrounding the object to be loaded.

Also, according to the present invention, the lift jack can move stably and can only move up and down without any shaking to the right or left when the object is loaded, because the center of balance is located at lower side of the cylinder apparatus.

Further, in the present invention, unexpected descending of the lift can be radically prevented to thereby avoid occurrence of safety accident by locking the lift portion physically by means of the safety device.

In addition, as the height of the lift jack of the present invention is about half of the conventional jack, it is easy to transport the loaded object to the ground or to transport the object to be loaded on the supporting plate, and also it is easy to move the lift jack apparatus into under the vehicle of a low height arranged in the working place and operate the lift jack apparatus.

Finally, in the cylinder apparatus of the present invention, it is possible to adjust the ascending and descending velocity of the lift jack to a desired degree progressively because of the installment of the transmission control device, which is operated to supply large volume of the fluids to ascend the lift jack at high velocity when the load has not been applied, that is, when the lift jack is activated initially, and to supply a little volume of fluids to ascend the lift jack at low velocity so that strong force can be transmitted when the load has been applied, at the time of the ascending and descending operations of the lift jack.

Although preferred embodiments of the present invention have been described for illustrative purposes, those skilled in the art will appreciate that various modifications, additions and substitutions are possible without departing from the scope and spirit of the invention as disclosed in the accompanying claims, and they fall in the scope of the present invention disclosed in the appended claims.

What is claimed is:

1. In a cylinder apparatus for a hydraulic lift jack with a transmission device, which includes a main hydraulic cylinder for pumping the oil stored in an oil tank, so that the lift jack can be ascended by the hydraulic pressure supplied by pumping, the cylinder apparatus is characterized by comprising:

lifting means including x-shaped beams for moving an upper plate pivotably engaged on an upper portion of the a beam up and down by the oil pressure in the main hydraulic cylinder;

fluid pumping means including the main hydraulic cylinder located below the lifting means for in-taking the oil stored in the oil tank installed at the inside of a base frame and pumping the oil to the outside, and a piston installed to move reciprocally within the main hydraulic cylinder; and pumping transmission means including a transmission control portion installed at the outside of the fluid pumping means for controlling the pumping volume of the oil so that an ascending velocity of a lift portion can be controlled progressively, and an oil pressure removing portion for the piston for removing the pressure of the oil flowed into the piston by the transmission control portion so that the fluid pumping means then can supply a little volume of oil; and wherein the lifting means is further comprised of:

a pair of arms pivotably engaged with each other by a plurality of connection members so that said arms are spaced apart from each other by a predetermined distance, in which one end of said arm is engaged pivotably with both free ends of a lift link, and the other end is pivotably engaged with each other by a boss formed with a first through-hole;

a pair of sub-arms pivotably engaged with each other by the connection member to be spaced apart from each other, in which one end is pivotably engaged with a respective arm, and the other end is pivotably engaged with a second boss formed with a second through-hole; and, a securing member provided with a guide shaft inserted slidably into the first and second through-holes formed at the first and second bosses, and on which a base plate is installed.

2. In a cylinder apparatus for a hydraulic lift jack with a transmission device, which includes a main hydraulic cylinder for pumping the oil stored in an oil tank, so that the lift jack can be ascended by the hydraulic pressure supplied by pumping, the cylinder apparatus is characterized by comprising:

lifting means including x-shaped beams for moving an upper plate pivotably engaged on an upper portion of the a beam up and down by the oil pressure in the main hydraulic cylinder;

fluid pumping means including the main hydraulic cylinder located below the lifting means for in-taking the oil stored in the oil tank installed at the inside of a base frame and pumping the oil to the outside, and a piston installed to move reciprocally within the main hydraulic cylinder; and pumping transmission means including a transmission control portion installed at the outside of the fluid pumping means for controlling the pumping volume of the oil so that an ascending velocity of a lift portion can be controlled progressively, and an oil pressure removing portion for the piston for removing the pressure of the oil flowed into the piston by the transmission control portion so that the fluid pumping means then can supply a little volume of oil; and wherein the fluid pumping means further comprises:

a cylinder supporting frame rotatably installed at one side of the base frame with centering about a first connection shaft;

the main hydraulic cylinder installed at the front of the cylinder supporting frame for in-taking the oil from the oil tank to transfer the oil pressure to the lift portion;

the piston installed within the main hydraulic cylinder for controlling the oil volume and pumping the fluids progressively according to the extension of the piston;

a piston head installed at the front of the piston, and in which a piston pin is installed at one side; and a piston holding jaw installed outside of the piston head for engaging the piston with a transmission control member formed slant at the center of a fixed shaft.

3. In a cylinder apparatus for a hydraulic lift jack with a transmission device, which includes a main hydraulic cylinder for pumping the oil stored in an oil tank, so that the lift jack can be ascended by the hydraulic pressure supplied by pumping, the cylinder apparatus is characterized by comprising:

lifting means including x-shaped beams for moving an upper plate pivotably engaged on an upper portion of the a beam up and down by the oil pressure in the main hydraulic cylinder;

fluid pumping means including the main hydraulic cylinder located below the lifting means for in-taking the oil stored in the oil tank installed at the inside of a base frame and pumping the oil to the outside, and a piston installed to move reciprocally within the main hydraulic cylinder; and pumping transmission means including a transmission control portion installed at the outside of the fluid pumping means for controlling the pumping volume of the oil so that an ascending velocity of a lift portion can be controlled progressively, and an oil pressure removing portion for the piston for removing the pressure of the oil flowed into the piston by the transmission control portion so that the fluid pumping means then can supply a little volume of oil;

wherein the transmission control portion of the pumping transmission means comprises a transmission lever installed at an upper end of a transmission supporting member installed at one side of the base frame, a supporting member for moving the main hydraulic cylinder and the piston up and down by the tensioning and relieving of a transmission wire connected to the transmission lever, and a securing base fixed to one side of the main hydraulic cylinder so that the supporting member can rotate at one side of the main hydraulic cylinder; and wherein the supporting member comprises a wire fixed member for holding and fixing the transmission wire and a cylinder supporting member for moving the main hydraulic cylinder and the piston up and down by operating to be erected vertically when the wire fixed member is tensioned by the transmission wire and to be laid down horizontally when the wire fixed member is relieved by the transmission wire at one side, and which is rotatably engaged at an upper end of the securing base by a spring of the supporting member at the other side.

4. In a cylinder apparatus for a hydraulic lift jack with a transmission device, which includes a main hydraulic cylinder for pumping the oil stored in an oil tank, so that the lift jack can be ascended by the hydraulic pressure supplied by pumping, the cylinder apparatus is characterized by comprising:

lifting means including x-shaped beams for moving an upper plate pivotably engaged on an upper portion of the a beam up and down by the oil pressure in the main hydraulic cylinder;

fluid pumping means including the main hydraulic cylinder located below the lifting means for in-taking the oil stored in the oil tank installed at the inside of a base frame and pumping the oil to the outside, and a piston installed to move reciprocally within the main hydraulic cylinder; and pumping transmission means including a transmission control portion installed at the outside of the fluid pumping means for controlling the pumping volume of the oil so that an ascending velocity of a lift portion can be controlled progressively, and an oil pressure removing portion for the piston for removing the pressure of the oil flowed into the piston by the transmission control portion so that the fluid pumping means then can supply a little volume of oil; and wherein the oil pressure removing portion for the piston comprises a first press member rotating outwardly from a first connection shaft when a pedal is actuated for reducing an extended length of the piston and removing the pressure in the piston by actuating a transmission lever, a second press member installed to rotate upwardly with centering a second connection shaft and coupled with the first press member, a piston rotating member for moving the piston to the inside of the main hydraulic cylinder along with the rotation of the second press member, an oil pressure removing member installed within the main hydraulic cylinder for returning the oil into the oil tank via a gap produced by pushing a piston hydraulic ball blocking the fluid path by pressing the second press member, and a hydraulic ball spring for returning the piston hydraulic ball to an initial position thereof when the oil pressure removing member is returned to an initial position thereof.

5. In a cylinder apparatus for a hydraulic lift jack with a transmission device, which includes a main hydraulic cylinder for pumping the oil stored in an oil tank, so that the lift jack can be ascended by the hydraulic pressure supplied by pumping, the cylinder apparatus is characterized by comprising:

lifting means including x-shaped beams for moving an upper plate pivotably engaged on an upper portion of the a beam up and down by the oil pressure in the main hydraulic cylinder;

fluid pumping means including the main hydraulic cylinder located below the lifting means for in-taking the oil stored in the oil tank installed at the inside of a base frame and pumping the oil to the outside, and a piston installed to move reciprocally within the main hydraulic cylinder; and pumping transmission means including a transmission control portion installed at the outside of the fluid pumping means for controlling the pumping volume of the oil so that an ascending velocity of a lift portion can be controlled progressively, and an oil pressure removing portion for the piston for removing the pressure of the oil flowed into the piston by the transmission control portion so that the fluid pumping means then can supply a little volume of oil; and a locking and unlocking mechanism, which is comprised of:

a locking lever having a desired length and which is pivotably engaged with a movable end of one of the x-shaped beam installed inside of the base frame, and in which an one-way latchet is installed;

an elastic poll engaged rotatably with a bracket installed at the base frame, and which is operated to engage with the latchet by a spring; and a coupling member operated to relieve the poll from the latchet by the operation of a pedal for removing the oil.

* * * * *